US012286783B2

(12) United States Patent
Stoltenberg

(10) Patent No.: US 12,286,783 B2
(45) Date of Patent: Apr. 29, 2025

(54) GUTTER SYSTEM, COVER UNIT AND SECURING ELEMENT

(71) Applicant: ACO AHLMANN SE & CO. KG, Budelsdorf (DE)

(72) Inventor: Arne Stoltenberg, Budelsdorf (DE)

(73) Assignee: ACO AHLMANN SE & CO. KG, Budelsdorf (DE)

( * ) Notice: Subject to any disclaimer, the term of this patent is extended or adjusted under 35 U.S.C. 154(b) by 422 days.

(21) Appl. No.: 17/756,378

(22) PCT Filed: Nov. 24, 2020

(86) PCT No.: PCT/EP2020/083174
§ 371 (c)(1),
(2) Date: May 24, 2022

(87) PCT Pub. No.: WO2021/105104
PCT Pub. Date: Jun. 3, 2021

(65) Prior Publication Data

US 2023/0003011 A1 Jan. 5, 2023

(30) Foreign Application Priority Data

Nov. 27, 2019 (DE) ..... 10 2019 132 119.0

(51) Int. Cl.
*E03F 5/06* (2006.01)

(52) U.S. Cl.
CPC ..... *E03F 5/06* (2013.01); *E03F 2005/063* (2013.01); *E03F 2005/065* (2013.01)

(58) Field of Classification Search
CPC .... E02D 29/14; E03F 5/06; E03F 3/04; E01C 11/22
See application file for complete search history.

(56) References Cited

U.S. PATENT DOCUMENTS

| | | | |
|---|---|---|---|
| 5,056,955 | A | 10/1991 | Spiess et al. |
| 5,466,091 | A | 11/1995 | Sauerwein et al. |

FOREIGN PATENT DOCUMENTS

| | | | |
|---|---|---|---|
| CN | 102575445 | A | 7/2012 |
| CN | 109072599 | A | 12/2018 |
| CN | 110382796 | A | 10/2019 |
| DE | 100 53 823 | C1 | 7/2002 |
| DE | 10346586 | A1 | 5/2005 |
| DE | 20 2007 000 757 | U1 | 4/2007 |

(Continued)

OTHER PUBLICATIONS

GB 2269831 Translation (Year: 1994).*

(Continued)

*Primary Examiner* — Bradley R Spies
(74) *Attorney, Agent, or Firm* — Chrisman Gallo Tochtrop LLC

(57) ABSTRACT

The invention relates to a gutter system (1) comprising at least one frame unit (10), at least one cover unit (20) and at least one securing element (30), wherein the frame unit (10) comprises at least one receiving area (12) for arranging the cover unit (20), and wherein the securing element (30) is adapted to engage in the cover unit (20) and to releasably engage in the receiving area (12) so the cover unit (20) can interlock in the receiving area (12) of the frame unit (10). The invention also relates to a cover unit (20) and a securing element (30).

10 Claims, 3 Drawing Sheets

(56) References Cited

FOREIGN PATENT DOCUMENTS

Figure 1:
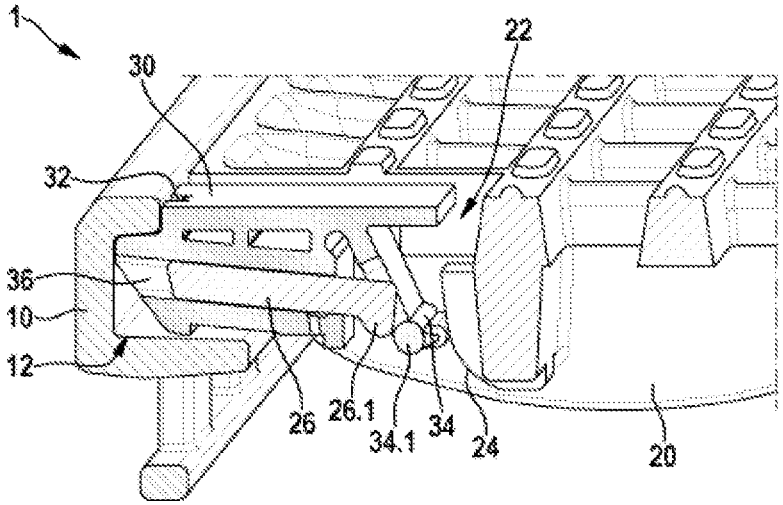

| | | | | | |
|---|---|---|---|---|---|
| DE | 10 2008 021 668 | A1 | | 11/2009 | |
| DE | 10 2008 021 669 | A1 | | 11/2009 | |
| EP | 0 317 919 | A1 | | 5/1989 | |
| EP | 0 601 445 | A1 | | 6/1994 | |
| EP | 0 675 230 | A1 | | 4/1995 | |
| EP | 3051034 | B1 | | 8/2016 | |
| GB | 2269831 | A | * | 2/1994 | ..... E01C 11/227 |
| RU | 2576268 | C1 | | 2/2016 | |
| RU | 185948 | U1 | | 12/2018 | |

OTHER PUBLICATIONS

The an Office Action issued in corresponding Russian Patent Application No. 2022116830/10(035489); Dated: Dec. 22, 2022.
The International Search Report issued in corresponding International PCT Application No. PCT/EP2020/083174; Mailing date: Feb. 19, 2021.
An Office Action issued in corresponding priority application DE 10 2019 132 119.0 dated Oct. 21, 2020.
An Office Action issued in corresponding Chinese Patent Application No. 202080082583.0; Dated; Mar. 22, 2024.

* cited by examiner

GUTTER SYSTEM, COVER UNIT AND SECURING ELEMENT

The invention relates to a gutter system comprising at least one frame unit, at least one cover unit and at least one securing element. The invention further relates to a cover unit and a securing element.

The cover unit or grate unit in common gutter systems for drainage is connected or interlocked with the frame unit. This is to allow the grate unit or cover unit in the frame unit to be secured against falling out and/or being lifted out.

Thick-walled gutter systems in particular however require a large grate width for this purpose, increasing the cost of producing such cast iron grates. The frame unit or channel wall itself must also be modified and designed using additional geometries in such a way to enable engagement in the wall.

The object of the present invention is to provide a gutter system which can be manufactured simply and inexpensively, enables an optimized grate or cover connection with different types of frame units, ensures simple assembly on site, and which allows simple maintenance and theft protection at the same time. The object of the invention is further to provide a cover unit and a securing element, particularly for said gutter system. This object is achieved by the subject matter of the gutter system, by the cover unit, and by the securing element. Preferred embodiments are set out in the dependent claims. According to the invention, a gutter system is provided with at least one frame unit, at least one cover unit and at least one securing element, wherein the frame unit has at least one receiving area for arranging the cover unit, and wherein the securing element is designed to engage, in particular to engage non-positively and/or positively, in the cover unit and to releasably engage in the receiving area so the cover unit can interlock in the receiving area of the frame unit.

The invention is based on the idea of providing a securing element which can be connected to the cover unit and enables a releasable connection to the frame unit. It should be in particular possible to achieve a captive connection of the securing element to the cover unit, whereby a connection of the cover unit to the frame unit can be released by means of the securing element as required.

By this, a secure and easy to establish connection or latching of the cover unit to the frame unit is achieved. At the same time, theft protection can be achieved as well.

The frame unit may preferably be symmetrically designed, so receiving areas are formed on both sides of the frame unit in the longitudinal direction of the gutter system. The securing element is provided for expedient engagement in the receiving area.

By the at least one securing element engaging only in sections in the receiving area of the frame unit, differently designed frame units can be used in combination with the securing element or the cover unit for the gutter system, no continuous receiving area along the frame unit in particular is necessary.

In a preferred embodiment, the securing element is elastically and/or plastically deformable in such a way that the engagement of the securing element in the at least one receiving area can be released as required, in particular by at least partial deformation of the securing element. This ensures that, when connected to the frame unit, the securing element or the cover unit can be released in a simple, expedient manner.

In a further embodiment, the at least one receiving area of the frame unit is designed as an undercut.

This allows the securing element to expediently engage in the frame unit to ensure a non-positive and/or positive connection between the cover unit and the frame unit, which can be released as required.

In a preferred embodiment, the securing element has a release area for engagement, in particular for engagement by means of a screwdriver, a lever element or the like, in order to apply a release force for elastic and/or plastic deformation of the securing element (30) to the securing element as required.

The at least one securing element of the gutter system is thus preferably operable solely by auxiliary means to release the engagement with the frame unit or the receiving area, and thus to release the connection between the frame unit and the cover unit.

In one embodiment, the securing element comprises a locking lever, wherein the locking lever is supported against the cover unit and applies a locking force so that the securing element engages non-positively and/or positively in the receiving area.

The elastically and/or plastically deformable locking lever of the securing element in particular allows the provision of a releasable connection between the cover unit and the frame unit in an expedient form with a predeterminable locking force.

In a further embodiment, the cover unit comprises at least one receiving opening for receiving and guiding the at least one securing element. The at least one securing element may thus preferably be received in the at least one receiving opening of the cover unit in an interlocked manner. A guide through the cover unit along the desired direction of movement of the securing element is further disposed in order to provide a releasable connection between the cover unit and the frame unit.

In a further embodiment, the at least one receiving opening comprises at least one bearing element and the securing element comprises at least one correspondingly configured bearing groove for receiving and guiding the securing element.

Alternatively, the bearing groove may be formed along the receiving opening of the cover unit, the bearing element being formed along the securing element.

This allows the provision of a connection or bearing and guide between the securing element and the cover unit. The securing element and the cover unit in particular can engage with each other.

The receiving opening may moreover have two bearing elements and the securing element may have correspondingly two bearing grooves, wherein the bearing elements are formed on opposite side surfaces of the receiving opening of the cover unit. This allows the provision of a double-sided or two-sided bearing and guiding of the securing element to ensure reliable functionality.

In one embodiment, the bearing element has a loss-preventing unit at a longitudinal end, in particular in the direction of a central area of the gutter system, so that the securing element and the cover unit can be connected non-positively and/or positively to provide a captive connection.

After initial connection, the securing element is thus non-positively and/or positively interlocked and expediently secured to the frame unit. For this purpose, the loss-preventing unit may be provided along the bearing element as an additional latch nose or the like. The locking lever may be designed in such a way that, when the connection is made between the cover unit and the securing element, the locking lever slides along the bearing element and overcomes the loss-preventing unit due to elastic deformation. The securing element can thus be secured or latched to the cover unit.

In a preferred embodiment, the at least one bearing element is of nose-shaped design. This provides a non-positive and/or positive engagement between the bearing element and the correspondingly configured bearing groove to allow expedient reception and guidance of the securing element.

In a further embodiment, the at least one receiving opening has a support surface for supporting the locking lever, so that a locking force can be exerted by the locking lever on the securing element.

In a further embodiment, the support surface is designed at least in sections with a rounding such that a release force to be applied to overcome the locking force of the locking lever is reduced along the support surface at least in sections or is adjustable based on the configuration of the rounding.

The at least sectional rounding of the support surface may in particular be designed such that a release force does not increase across the support surface, does not exceed a threshold value, or such that it is reduced.

In a preferred embodiment, the locking lever has at least one latch nose for engaging with and/or behind the loss-preventing unit.

This allows the provision of a non-positive and/or positive connection between the securing element and the cover unit.

In one embodiment, the at least one securing element is designed in one piece, and/or the at least one cover unit is designed in one piece. The cover unit and the securing element can preferably each be designed in one piece.

This allows the provision of a reliable, stable and expedient interlocking or connection between the cover unit and the securing element.

In an ancillary aspect of the invention, a cover unit for use with a gutter system according to the invention is provided, the cover unit having at least one receiving opening for receiving and guiding at least one securing element.

In another ancillary aspect of the invention, a securing element for use with a gutter system according to the invention and/or a cover unit according to the invention is provided.

The cover unit and the securing element may in particular be used with any type of frame unit having, at least on one side, a receiving area or the like for engagement by the securing element.

This allows the provision of universal use and easy connection or securing of the cover unit to a frame unit.

The invention will be explained hereafter in detail with reference to the accompanying drawings.

Figure 2A:
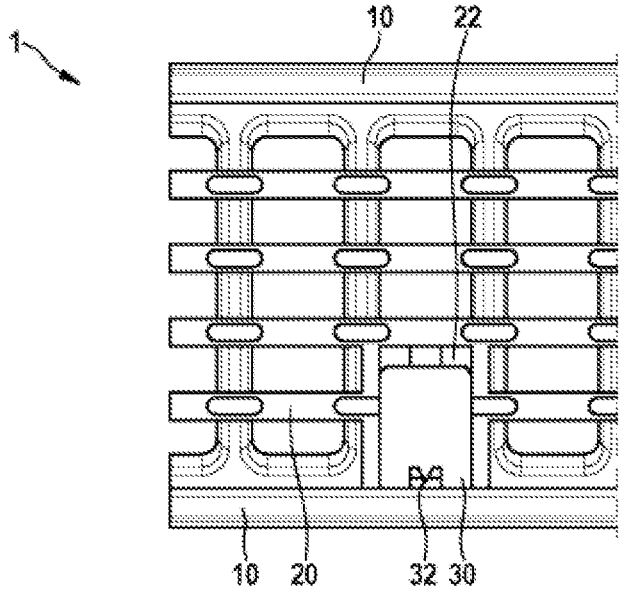
Figure 2B:
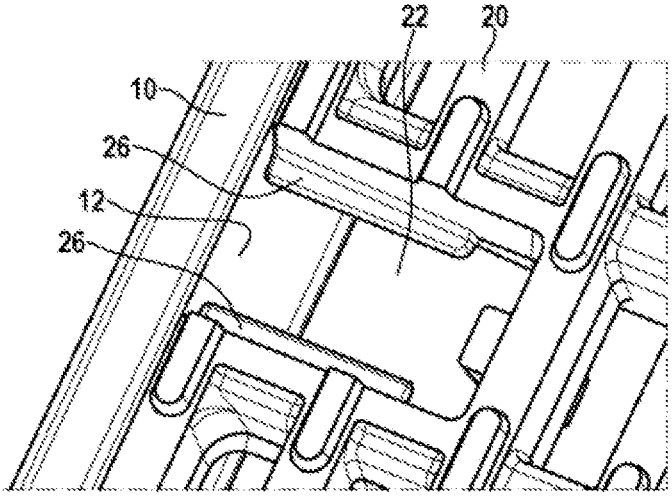
Figure 3A:
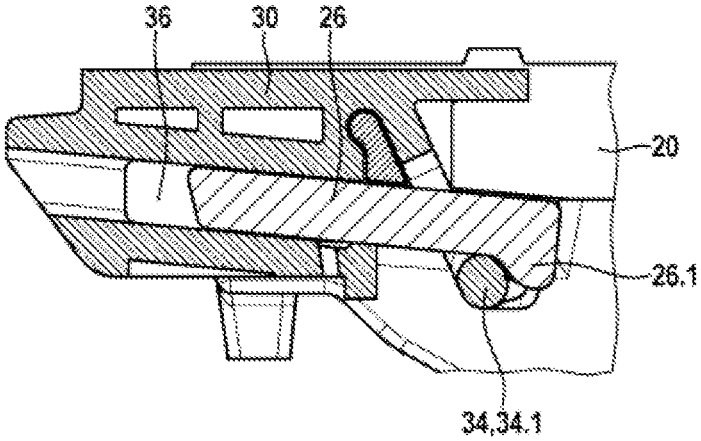
Figure 3B:
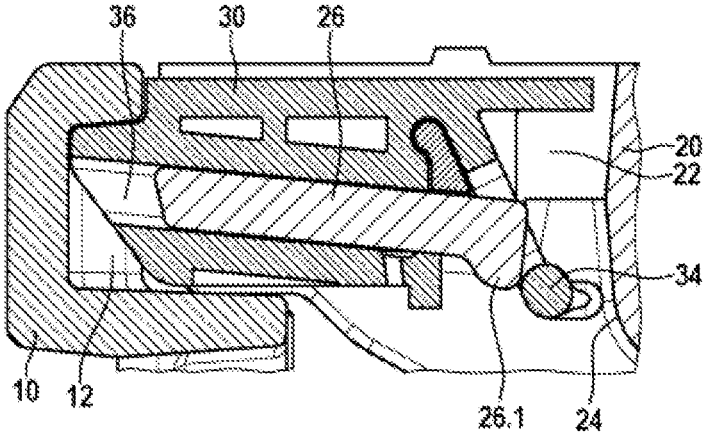
Figure 4:
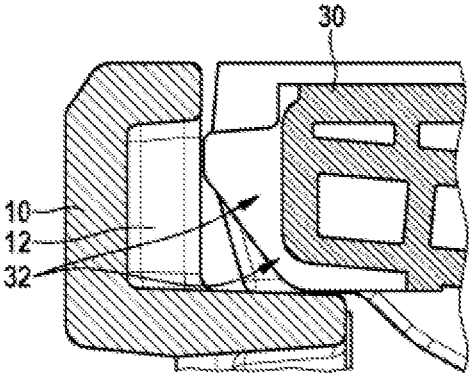

In particular schematically:

FIG. 1 shows a cross-sectional view of an exemplary embodiment of a gutter system comprising a frame unit, a cover unit and a securing element;

FIG. 2*a* shows a top view of the exemplary embodiment of FIG. 1;

FIG. 2*b* shows a perspective view of a frame unit and the cover unit according to the exemplary embodiment of FIG. 1;

FIGS. 3*a-b* show cross-sectional views of the exemplary embodiment of FIG. 1, in particular to illustrate the functionality of the securing element; and FIG. 4 shows another cross-sectional view of the exemplary embodiment of FIG. 1.

FIG. 1 shows a cross-sectional view of an exemplary embodiment of a gutter system 1 comprising a cover unit 20 and a securing element 30.

The frame unit 10 is designed with a receiving area 12 for bearing and receiving the cover unit 20. The receiving area 12 is at least partially designed as an undercut or in an undercut manner.

The cover unit 20 includes a receiving opening 22 for bearing and receiving the securing element 30. Essentially, the receiving opening may increase in size, at least in sections, from top to bottom, along the orientation of the cover unit 20 in conventional use. This allows debris or dirt, which may enter the receiving opening 22 from above, to fall through the lid or grate unit.

The receiving opening 22 is further designed with a support surface 24 in a central area of the cover unit 20 or the gutter system 1. The support surface 24 extends substantially in a vertical direction and has a radius or rounding at least at its lower end.

The frame unit 20 further comprises at least one bearing element 26. In FIG. 1, the bearing element 26 extends longitudinally and transversely to the longitudinal direction of the gutter system 1. The bearing element 26 may in particular be designed slightly inclined with respect to the horizontal.

The bearing element 26 may comprise a loss-preventing unit 26.1 at one end, in particular in the direction of the central area of the gutter system 1. The loss-preventing unit 26.1 may be designed as a bead or bulge along the bearing element 26. This allows the provision of a non-positive and/or positive connection of the cover unit 20 to the securing element 30. It ensures captive interlocking.

The securing element 30 in FIG. 1 is inserted in the cover or grate unit 20 and engages non-positively and/or positively with a first end in the receiving area 12 of the frame unit 10. By forming the securing element 30 with a phase along its underside at this first end, the securing element 30 can be engaged in the receiving area 12 of the frame unit 10 in a simplified manner.

The securing element 30 is provided with at least one bearing groove 36 which is designed to correspond to the bearing element 26 of the receiving opening 22 of the cover unit 20.

The bearing element 26 can thus engage non-positively and/or positively in the bearing groove 36. It allows the cover unit 20 to bear and guide the securing element 30.

The securing element 30 further has a locking lever 34 at a second end, which is arranged in the central area of the gutter system 1. The locking lever 34 is elastically and/or plastically deformable. The locking lever 34 is in particular provided such that it can bear against the support surface 24 to apply a locking force to the securing element 30 to ensure latching or engagement with the receiving opening 12 of the frame unit 10.

In view of the preferably elastically deformable locking lever 34, the securing element 30 may be understood as a spring-loaded securing element 30.

The securing element 30 further has a release area 32 which is provided for engaging with, for example, a screwdriver, a lever element or the like. This allows applying a release force to the securing element 30 solely by means of an auxiliary means, the release force which, supported on the support surface 24, exceeds the locking force of the locking lever 34 to thereby release the engagement of the securing element 30 in the receiving area 12 of the frame unit 10.

FIG. 2*a* shows a top view of the exemplary embodiment of FIG. 1, while FIG. 2*b* shows a perspective view of a frame unit 10 and the cover unit 20 according to the exemplary embodiment of FIG. 1.

In FIG. 2*a*, the release area 32 is designed centrally in the transverse direction of the securing member 30. The securing element 30 further may be designed such that it only partially closes the receiving opening 22.

The top surface of the securing element 30 may in particular be configured to protect the sliding connection between the bearing elements 26 and the bearing grooves 36 from contamination. The preferably at least partially downwardly funnel-shaped receiving opening 22 allows dirt and debris to fall through. Blocking of the securing element 30 is thus substantially avoided.

In FIG. 2*b*, a respective bearing element 26 is provided on both sides of the receiving opening 22. The bearing elements 26 are each nose-shaped and thus provide a receiving function, a guiding function and a sliding function for the securing element 30.

FIG. 2*b* further shows that the cover or grate unit 20 extends onto the receiving area 12 of the frame unit 10, the receiving area 12 being partially designed in an undercut manner.

FIGS. 3*a*-*b* show cross-sectional views of the exemplary embodiment of FIG. 1, in particular to illustrate the functionality of the securing element. FIGS. 3*a* and 3*b* show in particular the attachment or interlocking of the securing element 30 to the cover unit 20 to ensure a captive connection.

The securing element 30 is inserted along the bearing grooves 36 and the bearing elements 26 into the cover unit 20 or into the receiving opening 22 of the cover unit 20.

The locking lever 34 also slides along the bearing element 26 of FIG. 3*a*. The locking lever 34 is elastically deformable and slidable at the loss-preventing unit 26.1 of the bearing element 26 in such a way that the locking lever can snap over and the locking lever 34 slides across the loss-preventing unit 26.1 in the form of a bead or bulge of the bearing element 26.

The locking lever 34 may in particular have a latch nose 34.1 designed to engage behind and/or in the loss-preventing unit 26.1 of the bearing element 26.

This allows the securing element 30 in FIG. 3*b* to be latched to the cover unit 20. A captive connection or an interlocking between the cover unit 20 and the securing element 30 can be provided.

FIG. 4 shows a further cross-sectional view of the exemplary embodiment of FIG. 1. The formation of the release area 32 of the securing element 30 in particular is shown in cross-section.

In FIG. 4, only a lever-shaped auxiliary means, such as a screwdriver, can be selectively introduced into the release area from an upper side of the securing element. In particular by supporting the auxiliary means on the frame unit 10, a leverage effect to the securing element 30 is applicable by which a release force greater than the locking force of the supporting locking lever 34 can be applied. This allows displacing the securing element 30 along the bearing grooves 36 and bearing elements 26 in the center direction of the gutter system 1 and allows releasing any engagement of the securing element 30 in the undercut receiving area 12 of the frame unit 10.

In summary, the present invention allows the provision of a gutter system 1 having a simplified and low-cost structure, while ensuring a safe or secured reception of the cover or grate unit 20 along the frame unit 10. The cover unit 20 and/or the securing element 30 can in particular be used with any frame units 10 having at least one receiving area 12. Simple detachment of the cover unit 20 is further only possible by using auxiliary means by skilled personnel, thus ensuring expedient use in everyday life as well as theft protection. Due to the design of the security element 30 having the release area 32, the release function, by which force is applied counter to the locking force of the locking lever 34, is in particular at least partially concealed inside the gutter system 1.

LIST OF REFERENCE NUMERALS

1 gutter system
10 frame unit
12 receiving area
20 cover unit
22 receiving opening
24 support surface
26 bearing element
26.1 loss-preventing unit
30 securing element
32 release area
34 locking lever
34.1 latch nose
36 bearing groove

The invention claimed is:

1. A gutter system (1) comprising at least one frame unit (10), at least one cover unit (20) and at least one securing element (30), wherein the frame unit (10) comprises at least one receiving area (12) for arranging the at least one cover unit (20), and wherein the at least one securing element (30) is designed to engage in the at least one cover unit (20) and to releasably engage in the receiving area (12), such that the at least one cover unit (20) can interlock in the receiving area (12) of the frame unit (10), wherein the at least one cover unit (20) has at least one receiving opening (22) for receiving and guiding the at least one securing element (30), wherein the at least one receiving opening (22) has at least one bearing element (26) and the at least one securing element (30) has at least one correspondingly designed bearing groove (36) for receiving and guiding the at least one securing element (30), and wherein the at least one bearing element (26) has a loss-preventing unit (26.1) at a longitudinal end in the direction of a central area of the gutter system (1), such that the at least one securing element (30) and the at least one cover unit (20) can be connected non-positively or positively to provide a captive connection.

2. The gutter system (1) of claim 1, wherein the at least one securing element (30) is elastically or plastically deformable, such that the engagement of the at least one securing element (30) in the at least one receiving area (12) can be released.

3. The gutter system (1) of claim 1, wherein the at least one receiving area (12) of the frame unit (10) is designed as an undercut.

4. The gutter system (1) of claim 1, wherein the at least one securing element (30) has a release area (32) for engagement by means of a lever element in order to apply a release force to the at least one securing element (30) for elastic or plastic deformation of said at least one securing element (30).

5. The gutter system (1) of claim 1, wherein the securing element (30) has a locking lever (34), wherein the locking lever (34) is supported against the at least one cover unit (20) and applies a locking force, such that the securing element (30) engages non-positively or positively in the receiving area (12).

6. The gutter system (1) of claim 1, wherein the at least one bearing element (26) is of nose-shaped design.

7. The gutter system (1) of claim 1, wherein the at least one receiving opening (22) has a support surface (24) for supporting a locking lever (34), such that a locking force can be exerted by the locking lever (34) on the at least one securing element (30).

8. The gutter system (1) of claim 7, wherein the support surface (24) is designed at least in sections with a rounding, such that a release force to be applied to overcome the locking force of the locking lever (34) can be reduced at least in sections along the support surface (24).

9. The gutter system (1) of claim 5, wherein the locking lever (34) has at least one latch nose (34.1) for engagement in or behind the loss-preventing unit (26.1).

10. The gutter system (1) of claim 1, wherein the at least one securing element (30) is designed in one piece or the at least one cover unit (20) is designed in one piece.

* * * * *